US010952496B2

(12) United States Patent
Glancy

(10) Patent No.: US 10,952,496 B2
(45) Date of Patent: Mar. 23, 2021

(54) ARTICLE OF FOOTWEAR WITH INTERLOCKING MIDSOLE MEMBER

(71) Applicant: Under Armour, Inc., Baltimore, MD (US)

(72) Inventor: Michael Glancy, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 215 days.

(21) Appl. No.: 15/975,575

(22) Filed: May 9, 2018

(65) Prior Publication Data

US 2018/0325211 A1 Nov. 15, 2018

Related U.S. Application Data

(60) Provisional application No. 62/503,549, filed on May 9, 2017.

(51) Int. Cl.

| | |
|---|---|
| ***A43B 13/12*** | (2006.01) |
| ***A43B 13/22*** | (2006.01) |
| ***A43B 13/26*** | (2006.01) |
| ***A43B 13/28*** | (2006.01) |
| ***A43B 13/41*** | (2006.01) |
| ***A43B 5/00*** | (2006.01) |
| ***A43B 13/14*** | (2006.01) |

(52) U.S. Cl.

CPC ..... *A43B 13/125* (2013.01); *A43B 5/001* (2013.01); *A43B 13/14* (2013.01); *A43B 13/223* (2013.01); *A43B 13/26* (2013.01); *A43B 13/28* (2013.01); *A43B 13/41* (2013.01)

(58) Field of Classification Search

None

See application file for complete search history.

(56) References Cited

U.S. PATENT DOCUMENTS

| | | | | |
|---|---|---|---|---|
| D16,757 | S | 6/1886 | Cowen | |
| 354,693 | A | 12/1886 | Dick | |
| 1,111,437 | A | 9/1914 | Butterfield | |
| D56,809 | S | 12/1920 | Green | |
| D68,393 | S | 10/1925 | Murray | |
| 4,223,455 | A * | 9/1980 | Vermeulen | A43B 13/20 36/29 |
| D307,816 | S | 5/1990 | Schneider | |
| D307,817 | S | 5/1990 | Schneider | |
| D370,116 | S | 5/1996 | Passke et al. | |
| 5,595,004 | A | 1/1997 | Lyden | |
| 6,418,641 | B1 | 7/2002 | Schenkel | |
| D485,424 | S | 1/2004 | Kielt et al. | |
| D488,916 | S | 4/2004 | McClaskie | |

(Continued)

*Primary Examiner* — Jila M Mohandesi

(74) *Attorney, Agent, or Firm* — Maginot, Moore & Beck LLP

(57) ABSTRACT

An article of footwear includes an upper, a first sole member, and a second sole member. The first sole member is connected to the upper. Together, the first sole member and the upper define a cavity. The first sole member includes an outer surface and a textured inner surface, the textured inner surface defining a pattern of shapes. The second sole member is positioned in the cavity. The second sole member includes a textured lower surface directly engaging the textured inner surface of the first sole member. The textured lower surface of the second sole member is complementary to the textured inner surface of the first sole member.

15 Claims, 7 Drawing Sheets

(56) References Cited

U.S. PATENT DOCUMENTS 6,915,596 B2 * 7/2005 Grove ..... A43B 13/223 36/100
7,140,129 B2 * 11/2006 Newson ..... A43B 5/18 36/100
D540,015 S 4/2007 McClaskie
D541,511 S 5/2007 Wu
D551,833 S 10/2007 Feller
D572,462 S 7/2008 Hatfield et al.
D599,994 S 9/2009 Elliott et al.
7,712,229 B2 * 5/2010 Yang ..... A43B 1/0045 36/3 B
D650,159 S 12/2011 Avar
8,375,640 B2 * 2/2013 Willett ..... B60J 10/32 49/490.1
D677,453 S 3/2013 Sakai
D677,454 S 3/2013 Pizzuti
D680,722 S 4/2013 Link
D683,116 S 5/2013 Petrie
D684,347 S 6/2013 Chang
D689,680 S 9/2013 Chang
D690,920 S 10/2013 Petrie
D710,582 S 8/2014 Chang
D725,878 S 4/2015 Teng-Lee
D727,608 S 4/2015 Steven et al.
D769,592 S 10/2016 Kasprzak
D784,666 S 4/2017 Lok
D789,053 S 6/2017 Ruark
D791,454 S 7/2017 Lok
D792,692 S 7/2017 Schouwenburg et al.
9,693,604 B2 * 7/2017 Cin ..... A43B 13/14
D794,931 S 8/2017 Anceresi
D795,550 S 8/2017 Weiss
9,730,487 B2 8/2017 Davison
9,750,307 B2 9/2017 Campos, II et al.
D801,652 S 11/2017 Small
D802,900 S 11/2017 Ford
D804,157 S 12/2017 Pierone
D808,625 S 1/2018 Kohatsu et al.
9,867,427 B2 1/2018 Fujita et al.
D822,351 S 7/2018 DeAlmeida
10,123,585 B2 * 11/2018 Price ..... A43B 13/18
2004/0168349 A1 9/2004 Cole, III
2004/0221485 A1 * 11/2004 Pfander ..... A43B 1/0009 36/30 R
2005/0108898 A1 * 5/2005 Jeppesen ..... A43B 7/142 36/30 R
2008/0244926 A1 * 10/2008 Yu ..... C08L 23/0815 36/28
2008/0276490 A1 11/2008 Holt et al.
2009/0126230 A1 * 5/2009 McDonald ..... A43B 3/24 36/88
2010/0005684 A1 1/2010 Nishiwaki et al.
2010/0071232 A1 * 3/2010 Steele ..... A43B 3/30 36/91
2010/0170106 A1 7/2010 Brewer et al.
2014/0150297 A1 6/2014 Holmes et al.
2015/0013190 A1 1/2015 Davison
2015/0101215 A1 * 4/2015 Henderson ..... A43B 3/0057 36/103
2016/0037858 A1 2/2016 Foxen
2016/0073732 A1 3/2016 Ernst et al.
2016/0157558 A1 6/2016 Cross
2016/0255911 A1 9/2016 Fujita et al.
2017/0020228 A1 1/2017 Scofield et al.
2017/0042286 A1 2/2017 Meschter et al.
2017/0106015 A1 4/2017 Helmick
2017/0238652 A1 * 8/2017 Langvin ..... A43B 13/122
2017/0265564 A1 9/2017 Peyton
2017/0265566 A1 9/2017 Case et al.
2017/0266938 A1 9/2017 Hensley et al.
2017/0332737 A1 11/2017 Glancy et al.
2017/0340059 A1 11/2017 Campos et al.
2018/0077996 A1 3/2018 Peyton
2018/0184758 A1 7/2018 Glancy et al.
2018/0185731 A1 7/2018 Glancy
2018/0192736 A1 7/2018 Luedecke

* cited by examiner

ARTICLE OF FOOTWEAR WITH INTERLOCKING MIDSOLE MEMBER

CROSS-REFERENCE TO RELATED APPLICATIONS

This application claims priority to U.S. provisional patent application No. 62/503,549, filed May 9, 2018 and entitled, "Article of Footwear with Interlocking Midsole Member" the disclosure of which is incorporated herein by reference in its entirety.

FIELD

This document relates to the field of footwear, and particularly to a midsole member for footwear.

BACKGROUND

Articles of footwear are provided in various forms and configurations. For example, articles of footwear may be provided as shoes, boots, sandals, etc. These respective articles of footwear, may be configured for various uses as a dress footwear, athletic shoes for a field, athletic shoes for a court, running shoes, walking shoes, work shoes, etc. Comfort and durability are important design considerations for each of these shoe configurations. The sole of the footwear, including the outsole, midsole and insole are all components that factor significantly into user comfort.

In view of the foregoing, it would be advantageous to provide a sole for an article of footwear that is comfortable for the user. It would be of further advantage if the sole were configured to provide performance qualities for the user, such as improved stability, sound and energy dampening, as well as reduced weight. It would also be advantageous if the footwear could be manufactured relatively easily and at a reasonable cost.

SUMMARY

In accordance with at least one embodiment of the disclosure, there is provided an article of footwear comprising an upper, a first sole member, and a second sole member. The first sole member is connected to the upper. Together, the first sole member and the upper define a cavity. The first sole member includes an outer surface and a textured inner surface, the textured inner surface defining a pattern of shapes. The second sole member is positioned in the cavity. The second sole member includes a textured lower surface directly engaging the textured inner surface of the first sole member. The textured lower surface of the second sole member is complementary to the textured inner surface of the first sole member.

In accordance with another exemplary embodiment of the disclosure, there is provided a method of making an article of footwear. The method includes forming a multi-component sole having a toe plate and a heel plate. The heel plate has a greater hardness than the toe plate. The heel plate includes an upper textured surface including a pattern of repeating shapes, and at least one catch removed from the upper textured surface. The method further includes forming a midsole member including a lower textured surface and at least one retaining wall, the lowered textured surface complementary to the upper textured surface of the sole. The method also includes engaging the lower textured surface of the midsole member with the upper textured surface of the heel plate with the at least one retaining wall positioned between the upper textured surface and the catch of the heel plate. Additionally, the method includes attaching an upper to the multi-component sole such that a foot cavity is defined by the multi-component sole and the upper.

In accordance with yet another exemplary embodiment of the disclosure, there is provided an article of footwear comprising a multi-component sole including a heel plate and a toe plate. The heel plate has a greater hardness than the toe plate. The heel plate further includes a textured upper surface defining a first pattern of shapes. The midsole member engages the heel plate of the multi-component sole. The midsole member includes a textured lower surface defining a second pattern of shapes that is complementary to the first pattern of shapes. The textured lower surface of the midsole member is interlocked with the textured upper surface of the heel plate such that the midsole is blocked from sliding relative to the heel plate. Additionally, the midsole member has a lesser hardness than the heel plate.

The above described features and advantages, as well as others, will become more readily apparent to those of ordinary skill in the art by reference to the following detailed description and accompanying drawings. While it would be desirable to provide an article of footwear that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
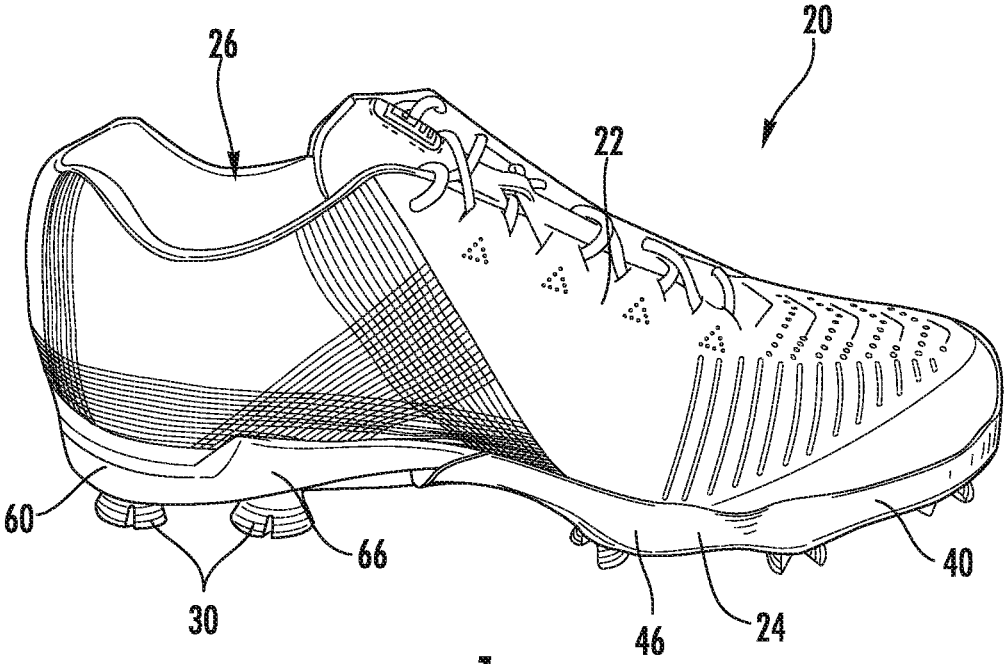
FIG. 1 shows a lateral side perspective view of an article of footwear in the form of a golf shoe including an upper and a sole.

With In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein, an "article of footwear" refers to an article of apparel designed and configured to be worn on a user's foot. Examples of articles of footwear include, but are not limited to: athletic shoes such as basketball shoes, running shoes, walking shoes, and tennis shoes; athletic cleated or spiked shoes such as golf shoes, football cleats, soccer cleats, baseball cleats, lacrosse cleats, and track spikes; boots such as hiking boots or skiing boots; ice skates; and roller skates or roller blades. The illustrated embodiments depict golf cleats, though the reader should appreciate that the midsole described herein may be used with any desired article of footwear.

Figure 2:
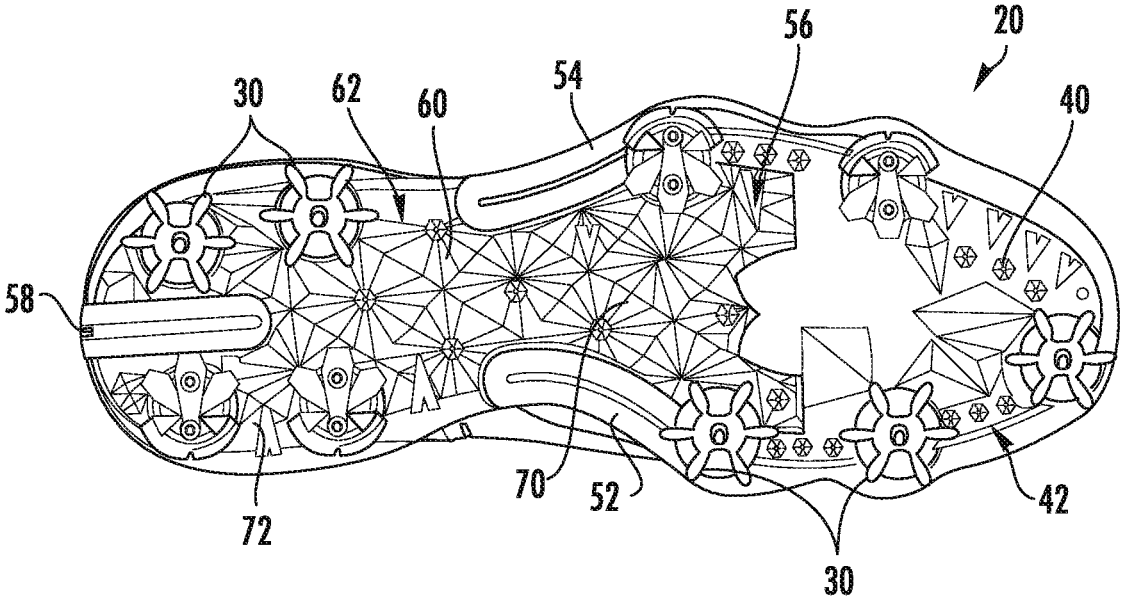
FIG. 2 shows a bottom plan view of the golf shoe of FIG. 1 including the sole with a plurality of cleats positioned thereon.

With reference now to FIGS. 1 and 2, an article of footwear is shown in the form of a golf shoe 20. The shoe 20 includes an upper 22 connected to a sole 24 to form a foot cavity 26. The sole 24 is a multi-component sole, including a toe plate 40 and a heel plate 60. As explained in further detail below, a midsole member 80 (see FIG. 10) engages an inner surface of the heel plate 60 within the foot cavity, and provides effective cushioning and support for the wearer of the shoe 20.

With particular reference to FIG. 1, the upper 22 includes a plurality of components that cover the foot of a wearer when the article of footwear 20 is worn on the foot. Exemplary components of the upper 22 include a heel (or heel counter), a tongue, a vamp, and a toe (or toe cap), along with any of various other components as will be recognized by those of ordinary skill in the art. While the article of footwear has been disclosed herein as a golf shoe 20, it will be recognized that the article of footwear may be provided in different forms in alternative embodiments. For example, the article of footwear may be provided as a baseball shoe, a football shoe, a soccer shoe, a work shoe, a dress shoe or any of various other types of articles of footwear. Moreover, while the configuration of the upper 22 disclosed herein provides a low-cut shoe, the article of footwear may also be provided in various form such as a high-top shoe, a boot, a sandal, or any of various other types of footwear.

In addition to being provided in any of various forms and configurations, the upper 22 may also be comprised of any of various materials. For example, the upper 22 may include one or more panels comprised of polyester, elastane, mesh, synthetic leather or natural leather, or any of various other materials or combinations thereof. Additionally, the upper may include additional materials and components such as foam padding, polymer sheets, fastening members, support structures, as well as any of various other materials and components. The materials and components used on the upper 22 may depend, in part, on the particular type of footwear formed by the upper 22.

The sole 24 is connected to the upper 22 using any of various conventional means, such as stitching, adhesives, welding, etc. Together, the sole 24 and the upper 22 form a foot cavity 26 that is configured to receive and retain a human foot. With particular reference to FIG. 2, the sole 24 is a multi-component sole including a forward member in the form of a toe plate 40, a rearward member in the form of a heel plate 60. Both the toe plate 40 and the heel plate 60 include outer surfaces that are exposed on the bottom of the shoe 20. These outer surfaces face downward and come into contact with the ground when the user walks with the shoe 20 on his or her foot (but it should be noted that the sole 24 may not actually contact the ground if the cleats 30 are arranged on the sole 24 and the user walks on hard ground that prevents the cleats 30 from digging into the ground). Because the toe plate 40 and the heel plate 60 are configured to contact the ground, the surfaces of the toe plate 40 and the heel plate 60 may be considered to form an outsole for the shoe 20. Alternatively, the heel plate 60 may be considered to be part of a midsole for the shoe, since the heel plate 60 is slightly elevated relative to the toe plate 40 and a central heel strip 58 on the bottom of the shoe.

Regardless of whether the heel plate 60 is considered to be the outsole and the midsole of the shoe 20, it will be recognized that the sole 24 is comprised of a number of different components in the embodiments that include a heel plate 60 and a toe plate 40. However, in other embodiments, the sole 24 may be provided in other configurations different from that shown in FIG. 2, including a sole with a unitary outsole that extends from the heel to the toe of the shoe 20. Additionally, it will be recognized that the components of the sole 24 may be comprised of any of various materials and combinations thereof that provide the desired features and performance qualities for the sole 24. In at least some embodiments, the sole may be comprised of different materials such as a thermoplastic polyurethane (TPU), natural rubber, carbon rubber, blown rubber, styrene-butadiene copolymer (SBR), polybutadiene, ethylene-vinyl acetate (EVA), or any of various other materials as will be recognized by those of ordinary skill in the art as appropriate for use in association with the toe plate 40.

The toe plate 40 includes an outer surface 42, an inner surface 44 (see FIG. 9), and sidewalls 46. As shown in FIG. 2, the toe plate 40 extends around a perimeter of the sole 24 from the medial side of a midfoot region (e.g., a region generally associated with the cuboid, navicular and portions of the metatarsal bones of a human foot), around the toe region (e.g., a region generally associated with the phalanges bones of a human foot), and to a lateral side of the midfoot region. The toe plate 40 covers the entire toe region, but only covers the perimeter of the midfoot region. Accordingly, the toe plate includes a forward portion 50, a medial arm 52, and a lateral arm 54. The forward portion 50 covers the entire toe region. The medial arm 52 and lateral arm 54 extend from the forward portion 50 into the midfoot region along the perimeter of the sole 24. In particular, the medial arm 52 may extend along a region of the sole 24 that is associated with a medial plantar fascia region of the foot, extending along the metatarsal bones and to the tarsal bones. Similarly, the lateral arm 54 may extend along a region of the sole 24 that is associated with the lateral plantar fascia region of the foot, extending along the metatarsal bones and to the tarsal bones. The sidewalls 46 of the toe plate 40 also extend along the perimeter of the toe plate across the front of the forward portion 50, and along the medial arm 52 and the lateral arm 54.

The configuration of the toe plate 40 provides a horseshoe-like structure on the outsole 24. In particular, the arrangement of the forward portion 50 of the toe plate 40 with the medial arm 52 and lateral arm 54 extending therefrom provides an arcing structure that extends along the perimeter of the toe region and midfoot region with a central opening formed within the arcing structure (i.e., the medial arm 52 and the lateral arm 54 defined a central opening 56 in the toe plate 40 in midfoot region and the heel plate 60 extends into this central opening).

The arms 52 and 54 of the toe plate 40 have a width between about 1 cm and 3 cm, depending on the size of the shoe, the width extending from an outer perimeter to an inner perimeter of the arm. For example, in at least one embodiment, the arms 52 and 54 may have a width of between about 1.0 and 2.0 cm, and particularly about 1.5 cm, for a men's size nine shoe. The arms 52 and 54 have a length between about 6 cm and 16 cm, depending on the size of the shoe, the length extending from the proximal end to the distal end of the arm. For example, in at least one embodiment, the arms 52 and 54 may have a length of about 10 cm for a men's size nine shoe.

The central heel strip 58 is comprised of the same material as the toe plate 40. The central heel strip extends from the top of the sidewall 66 at a lower Achilles position of the heel plate 60 to a central heel location associated with the calcaneus bone on the human foot. The central heel strip is an elongated strip of material that is longer than it is wide and is centrally located between a medial and lateral side of the heel region. In at least one embodiment, the central heel strip 58 has a length between about 6 cm and 12 cm and a width between 1.0 and 2.0 cm, depending on the size of the shoe.

With reference again to FIGS. 1 and 2, the heel plate 60 includes the outer surface 62, an inner surface 64 (see FIG. 9), and sidewalls 66. The sidewalls 66 extend around the perimeter of a rearward portion 72 of the heel plate 60, but do not extend to the forward portion 70. Recesses 68 are formed along an upper edge of the sidewalls 66 on the lateral side and the medial side of the heel plate 60. As explained in further detail below, these recesses 68 are configured to receive heel tabs 87 of the midsole member 80.

The forward portion 70 of the heel plate 60 extends along a region of the sole generally associated with the plantar aponeurosis region of the human foot, similarly extending from the tarsal bones to the metatarsal bones. The forward portion 70 of the heel plate 60 is positioned in the midfoot region of the sole 24 between the medial arm 52 and the lateral arm 54 of the toe plate 40.

The rearward portion 72 of the heel plate 60 is a monolithic construction with the forward portion 70 of the heel plate 60 (i.e., the rearward portion 72 and the forward portion 70 are a unitary, integrally formed component). The rearward portion 72 of the heel plate 60 covers the entire heel region of the sole 24. Accordingly, the rearward portion 72 extends along a region of the sole 24 generally associated with the tarsal bones of the human foot.

Similar to the toe plate 40, the heel plate 60 may be comprised of any of various materials such as a thermoplastic polyurethane (TPU), natural rubber, carbon rubber, blown rubber, styrene-butadiene co-polymer (SBR), polybutadiene, ethylene-vinyl acetate (EVA), or any of various other materials as will be recognized by those of ordinary skill in the art as appropriate for use in association with the heel plate 60. In at least one embodiment, both the heel plate 60 and the toe plate 40 are comprised of a TPU or other elastomer material. The heel plate 60 is generally harder than the toe plate 40. Because the heel plate 60 has a hardness that is greater than the toe plate 40, the durometer of the TPU of the heel plate 60 is greater than the durometer of the TPU of the toe plate 40. Accordingly, the toe plate 40 tends to flex more easily than the heel plate 60. This provides the user with significant comfort when walking while also offering desired flex regions and stability regions during the golf swing. Nevertheless, in at least some alternative embodiments, the toe plate 40 may have a hardness that is greater than that of the heel plate 60.

Figure 3:
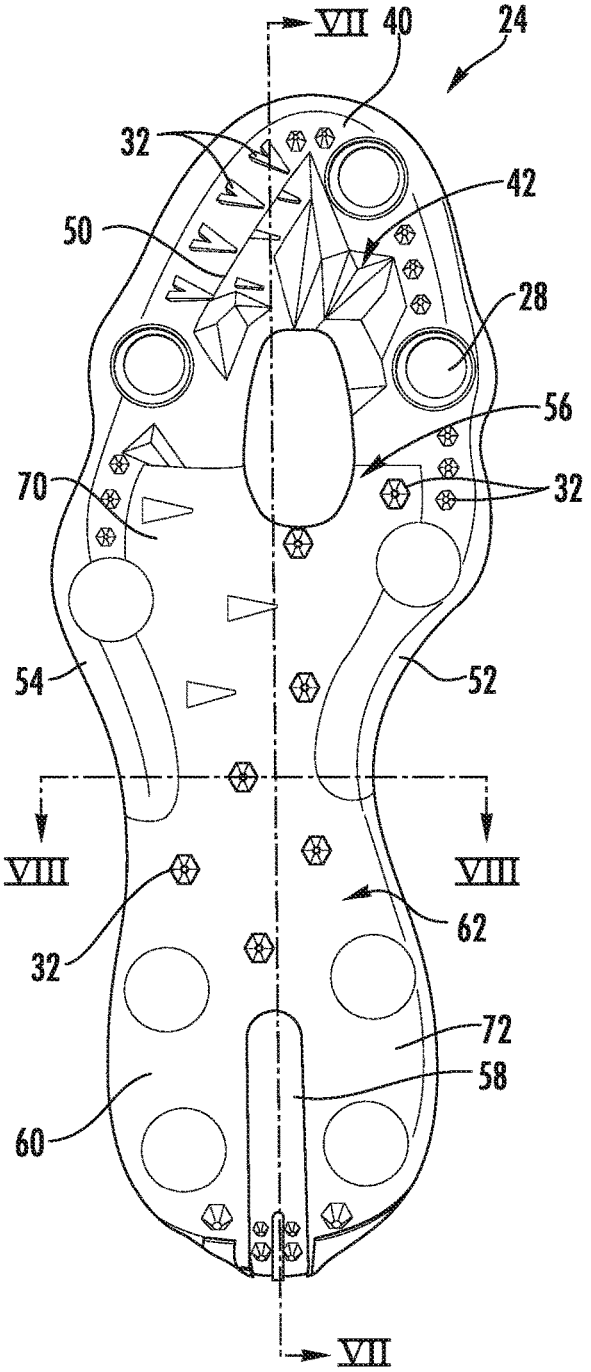
FIG. 3 shows a bottom plan view of an outer surface of the sole of the article of footwear of FIG. 1 in isolation from the upper.

With reference now to FIG. 3, the contours of the outer surface 42 of the toe plate 40 and the outer surface 62 of the heel plate 60 are shown with the cleats 30 removed from the sole 24, exposing cleat mounts 28 on the toe plate 40 and heel plate 60. The cleat mounts 28 are configured to releasably retain the cleats 30 on the sole 24. The cleats 30 serve as primary traction members for the shoe 24. However, as best shown in FIG. 3, the outer surface 42 of the toe plate 40 and outer surface 62 of the heel plate 60 also include a plurality of secondary traction members 32. The secondary traction members 32 may include one or more protrusions that protrude outward on the downward facing outer surfaces 42 and 62. The protrusions may be provided in any number of different forms, such as spikes, obelisks, inverted pyramids, or other portions of polyhedron structures. In the embodiment of FIG. 3, the secondary traction members 32 on the downward facing outer surfaces 42 and 62 may further include differently shaped polygon structures 100 that form a number of facets, similar to those discussed in further detail below in association with the inner surface 64 of the heel plate 60.

Figure 4:
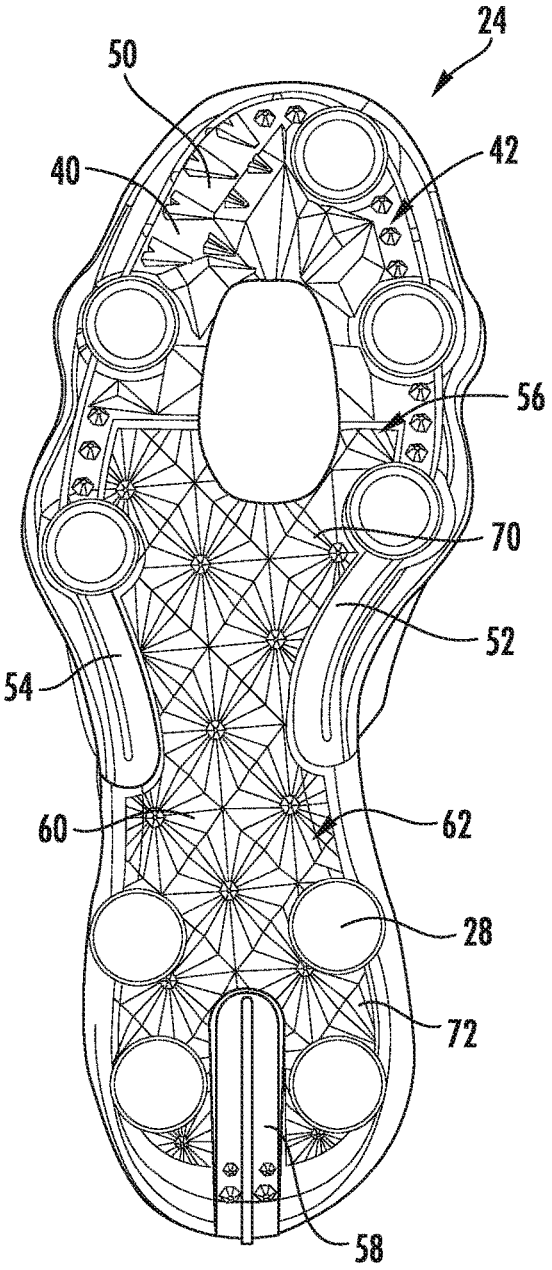
FIG. 4 shows a bottom view of the sole of the article of footwear of FIG. 1 with secondary traction members removed from a heel plate, the heel plate comprised of a transparent material thereby exposing the texture on an inner surface of the heel plate.

In at least one embodiment, the heel plate 60 is comprised of a clear or generally transparent material. Accordingly, when the user views the bottom of the sole 24, and particularly the outer surface 62 of the heel plate 60, the user is able to see the inner surface 64 of the heel plate 60. The inner surface 64 of the heel plate 60 is textured to provide a unique design that is visible on the bottom of the sole 24. FIG. 4 shows the sole 24 in isolation from the upper 22 with the toe plate 40 provided by an opaque material and the heel plate 60 provided by a transparent material. The secondary traction members 32 removed from the outer surface 62 of heel plate 60 of the sole 24 in FIG. 4 to better show the textured inner surface 64 visible through the transparent heel plate 60. In at least one embodiment, the textured inner surface 64 includes a color layer to further emphasize the features on the inner surface 64 of the heel plate 60 when viewed from the bottom of the sole 24. The color layer may be provided in a color that is contrasted with the toe plate 40 to further emphasize the distinction between the toe plate 40 and the heel plate 60. For example, in at least one embodiment, the toe plate 40 is a black color, and although the heel plate 60 itself is generally transparent or clear, the color layer on the inner surface 64 of the heel plate 60 is silver. As explained herein, the textured inner surface 64 of the heel plate 60 not only provides a unique design feature for the shoe 20, but also acts as an interlocking surface for the midsole member 80.

Figure 5:
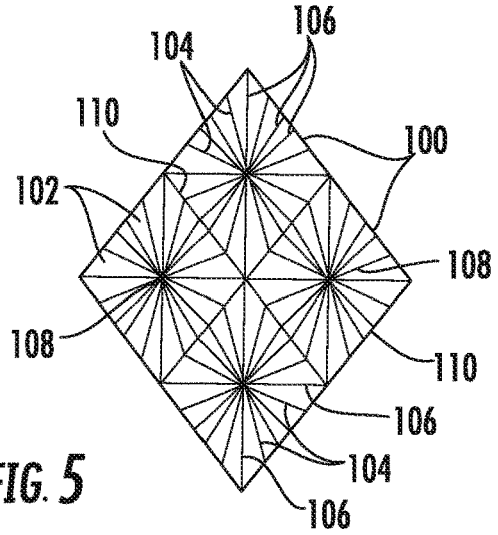
FIG. 5 shows a pattern of repeating faceted polygons in isolation from the sole.

As shown in FIG. 4, the textured inner surface 64 of the heel plate 60 (which may also be referred to herein as a textured "upper" surface of the heel plate) defines a pattern of repeating shapes, and particularly a pattern of three-dimensional polygon structures 100 (i.e., the polygon structures include multiple individual polygons arranged in three dimensions to provide a texture to the inner surface 64; accordingly multiple polygons in a polygon structure may alternatively be referred to as "polyhedron structures" on the inner surface of the heel plate 60). Many of the polygon structures 100 are interrupted in FIG. 4 by various features of the sole 24, such as the perimeter of the sole 24 and the cleat mounts 28. Accordingly, for the sake of clarity, four complete polygon structures are shown in FIG. 5. As used herein, the term "pattern" of polygon structures does not mean that each polygon structure must be complete, but only that the general shape of the polygon structure is repeated in a pattern-like manner. Accordingly, various features that disrupt an otherwise complete polygon structures in a group does prevent the group of polygon structures from providing a "pattern" of polygon structures.

With reference now to FIG. 5, a pattern of four faceted polygon structures is shown. The faceted polygons are the same as the polygon structures in FIG. 4, but are isolated in FIG. 5 and uninterrupted for the sake of clarity. As shown in FIG. 5, each polygon structure 100 is generally rhombus or diamond-shaped along the perimeter edges 110 and has a peak 108 at a center of the polygon structure with a number of polygon-shaped facets 102 surrounding the peak 108. In the embodiment of FIG. 5, each of the facets has a triangular shape. The triangular facets 102 all share a common vertex at the peak 108. Ridges 104 or grooves 106 are formed along the common edges of adjacent facets. The ridges 104 extend generally parallel with the peaks 108, and the grooves 106 are generally sloped downward from the peaks 108. The remote edge of adjacent facets 102 from different polygon structures are either flat or sloped upward or downward. Accordingly, the perimeter edges 110 of each polygon structure have a wave-like structure alternating higher and lower positions along the perimeter of the polygon structure 100 (i.e., higher and lower relative to a plane defined by the heel plate 60).

Although FIG. 5 shows four polygon structures 100 with diamond-shaped perimeters, it will be recognized that the outsole 24 may include different polygon structures, fewer polygon structures, or additional polygon structures. Accordingly, the polygon structures of FIGS. 4 and 5 are but one exemplary embodiment of faceted polygons that may be provided on the outsole, and numerous additional embodiments of differently shaped polygon structures and associated configurations are possible, including differently shaped perimeters and differently shaped facets for such polygon structures.

With general reference now to FIGS. 6-11, a midsole member 80 is configured to engage the inner surface 64 of the heel plate 60. The midsole member 80 includes a lower surface 84 (see FIG. 6), an upper surface 82 (see FIG. 9), and sidewalls 86 (see FIG. 8) extending between the upper surface 82 and the lower surface 84. The upper surface 82 of the midsole member 80 is configured to face a human foot positioned in the foot cavity 26. The lower surface 84 of the midsole member 80 is textured and configured to engage the inner surface 64 of the heel plate 60. The sidewalls 86 of the midsole member 80 are complementary to and/or configured to engage the interior surface of the sidewalls 66 of the heel plate 60. The midsole member 80 is comprised of a material configured to provide cushioning and support for the foot of the wearer. For example, in at least one embodiment, the midsole member 80 is comprised of an EVA foam. However, it will be recognized that in alternative embodiments the midsole member may be comprised of a different material, such as a material similar to that of the toe plate 40, heel plate 60, or other elastomer. In any event, the midsole member 80 typically has a hardness that is less than that of the heel plate 60 and the toe plate 40. Accordingly, the midsole member is configured to provide the user with significant additional comfort and support when walking, while also offering desired flex regions and stability regions during the golf swing.

Figure 6:
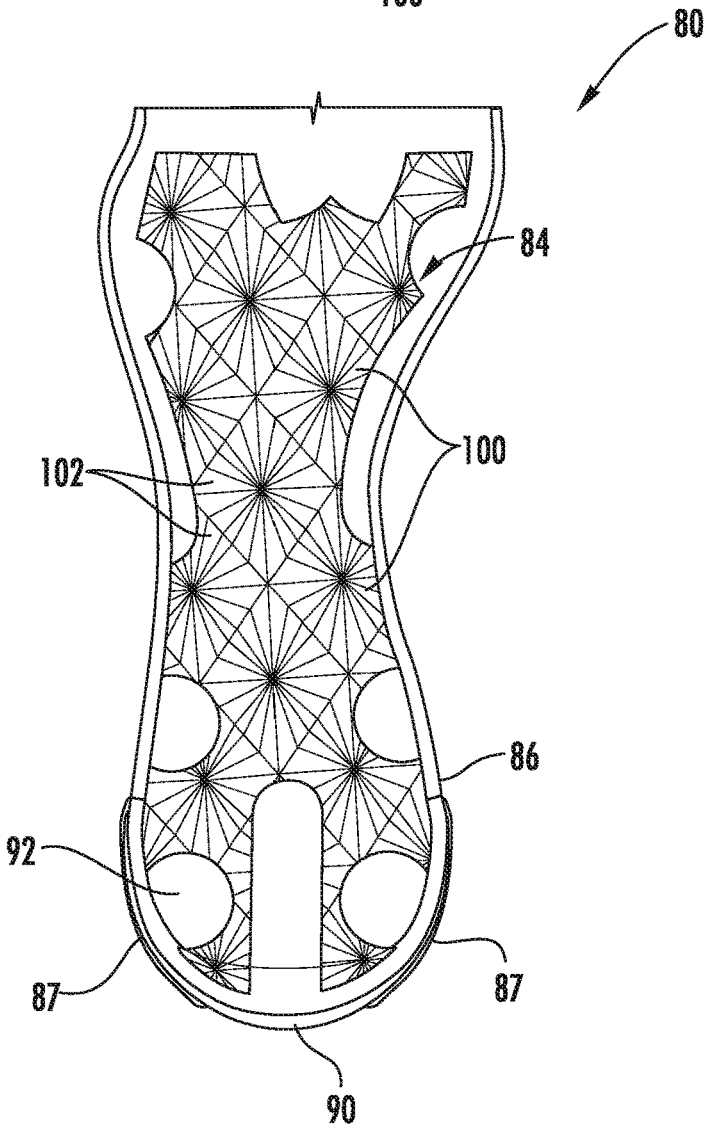
FIG. 6 shows a bottom plan view of a midsole member configured to engage the textured inner surface of the heel plate of FIG. 4.

FIG. 6 shows a bottom view of the midsole member 80, and particularly the lower surface 84 of the midsole member 80. The lower surface 84 of the midsole member 80 is defined by a perimeter that is similar in shape to that of the heel plate 60. In particular, as shown in FIG. 6, the perimeter defines a heel end 90, a bulbous heel region 92, a midfoot end 94, a midfoot region 96, and an inwardly curving neck 98 extending from the heel region 92 to the midfoot region 96.

The lower surface 84 of the midsole member 80 is a textured surface that is complementary to the inner surface 64 of the heel plate 60. Accordingly, the textured lower surface 84 includes a plurality of faceted polygon structures 100 similar to that shown in FIG. 5. Each polygon structure 100 is generally rhombus or diamond-shaped along a perimeter and has a center indentation (which is complementary to peak 108) at a center of the polygon structure with a number of triangular facets 102 surrounding the center indentation. The triangular facets all share a common vertex at the center indentation. Grooves (which are complementary to ridges 104) or peaks (which are complementary to grooves 106) are formed along the common edges of adjacent facets. The grooves extend generally parallel with the center indentation, and the ridges generally sloped downward from the center indentation. The remote edge of adjacent facets from different polygon structures are either flat or sloped upward or downward. Accordingly, the perimeter edges of each polygon structure have a wave-like structure alternating higher and lower positions along the perimeter of the polygon structure.

In view of the description above, it will be recognized that the textured lower surface 84 of the midsole member 80 is complementary to the textured inner surface 64 of the heel plate 60. Stated differently, the textured lower surface 84 of the midsole member 80 engages or fits into the textured inner surface 64 of the heel plate 60 in a "hand-in-glove" or "lock-and-key" manner. Therefore, peaks on the textured inner surface 64 of the heel plate 60 fit into complimentary indentations on the textured lower surface 84 of the midsole member 80. Similarly, grooves on the textured inner surface 64 of the heel plate 60 receive complimentary protrusions on the textured lower surface 84 of the midsole member 80. In this manner, when the textured lower surface 84 of the midsole member 80 is engaged with the textured inner surface 64 of the heel plate 60, the interlocking textured surfaces interact with each other and prevent the midsole member 80 from sliding relative to the heel plate 60. The interlocking surfaces help secure the position of the midsole member 80 in place on the outsole, and particularly the heel plate 60, preventing slipping and sliding of the components relative to one another. Accordingly, in at least one embodiment little or no additional adhesive, stitching, welding or other fastening means are required to secure the midsole member 80 to the heel plate 80, and the reduction in the use of additional fastening features and components results in additional comfort to the wearer.

Figure 7:
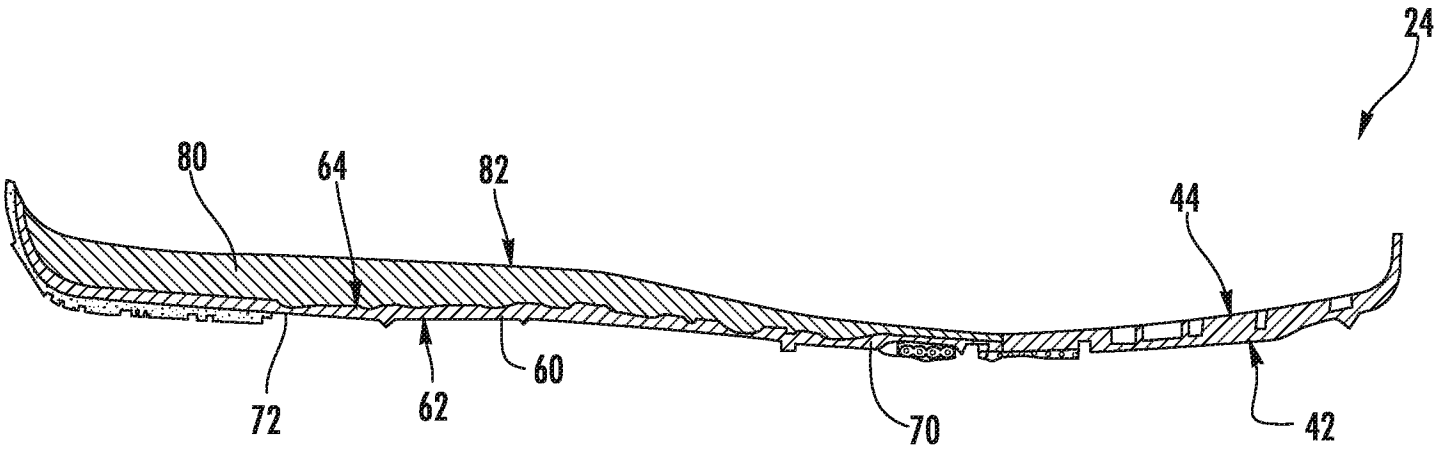
FIG. 7 shows a cross-sectional view of the sole along line VII-VII of FIG. 3, the sole having a midsole member positioned thereon.
Figure 8:
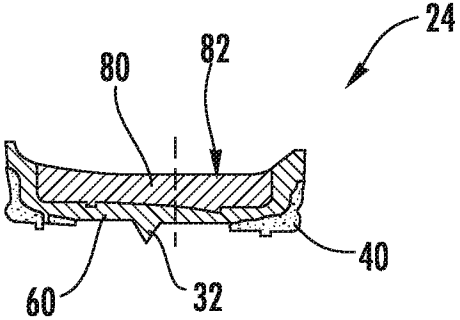
FIG. 8 shows another cross-sectional view of the sole along line VIII-VIII of FIG. 3, the sole having a midsole member positioned thereon.

With reference now to FIGS. 7-11, the midsole member 80 is received within a slot 74 in the heel plate 60. The slot 74 of the heel plate is generally defined by the sidewalls 66 which extend upward from the outer surface 62 of the heel plate 60. The midsole member 80 has a similar length and width to that of the heel plate 60 as defined within the sidewalls 66 that form the slot 74. As best shown in FIG. 7, the midsole member 80 has a greater height (or thickness) at the heel end than at a midfoot end, and gradually tapers in height from the heel end to the midfoot end. Accordingly, the height of the midsole member 80 is significantly greater than the height of the heel plate 60 at the heel end 90, and is similar in height to the heel plate 60 near the midfoot end 94.

Figure 10:
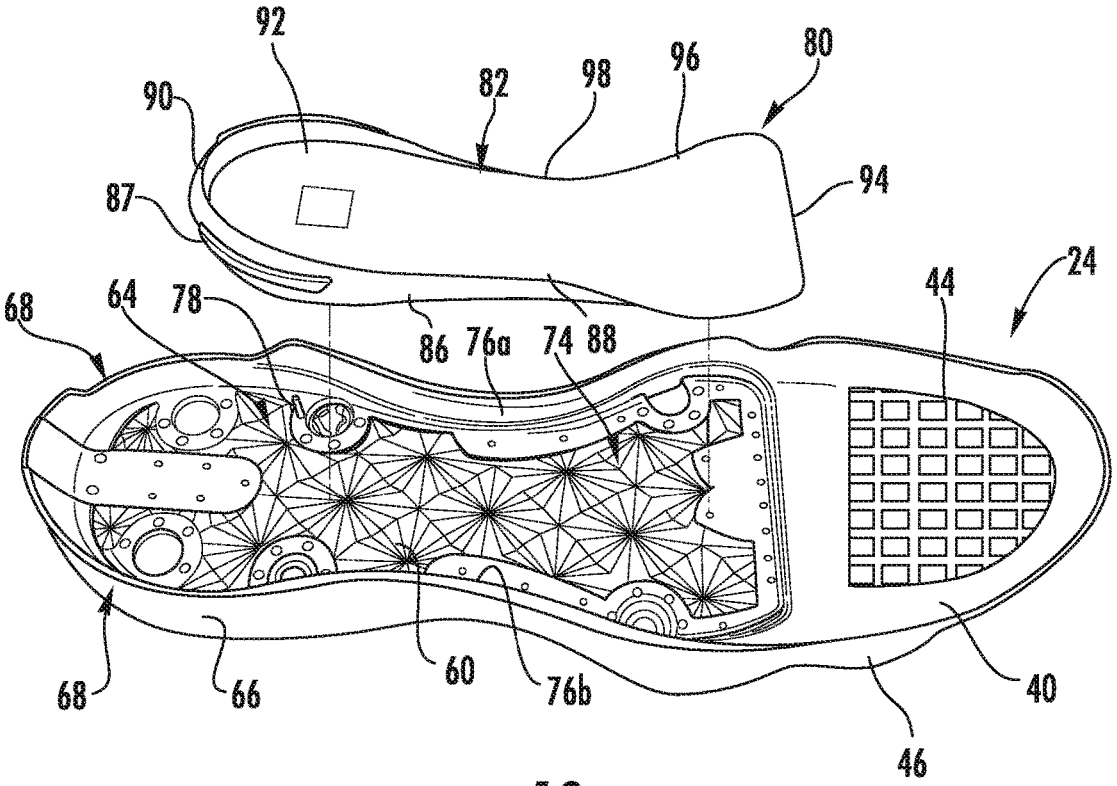
FIG. 10 shows the sole of FIG. 8 with the midsole member removed from the outsole.

As best shown in FIG. 10, a catch 76 is defined along the sidewall 66 in the slot 74 of the heel plate 60. The catch 76 is configured to retain the midsole member 80 within the slot 74 of the heel plate 60. In the embodiment of FIG. 10, the catch 76 is provided by a medial rib 76*a* and a lateral rib 76*b*, the ribs positioned on the interior medial and lateral sides of the sidewall 66. Each rib 76*a*, 76*b* abuts an angled portion 88 of the sidewall 86 of the midsole member 80. The angled portion 88 of the sidewall 86 extends downwardly and outwardly into a space defined between the rib and the inner surface 64 of the heel plate 60. The angled portion 88 extends along a portion of the midsole member 80 located about half-way between the heel end and the midfoot end of the midsole member. Accordingly, the angled portion 88 of the sidewall provides a retaining wall such that the medial and lateral sides of the midsole member 80 are engaged by the ribs 76*a* and 76*b* of the heel plate 60 at a central location, and the midsole member 80 is thereby retained in the slot 74 by the catch 76 of the heel plate 60.

Figure 9:
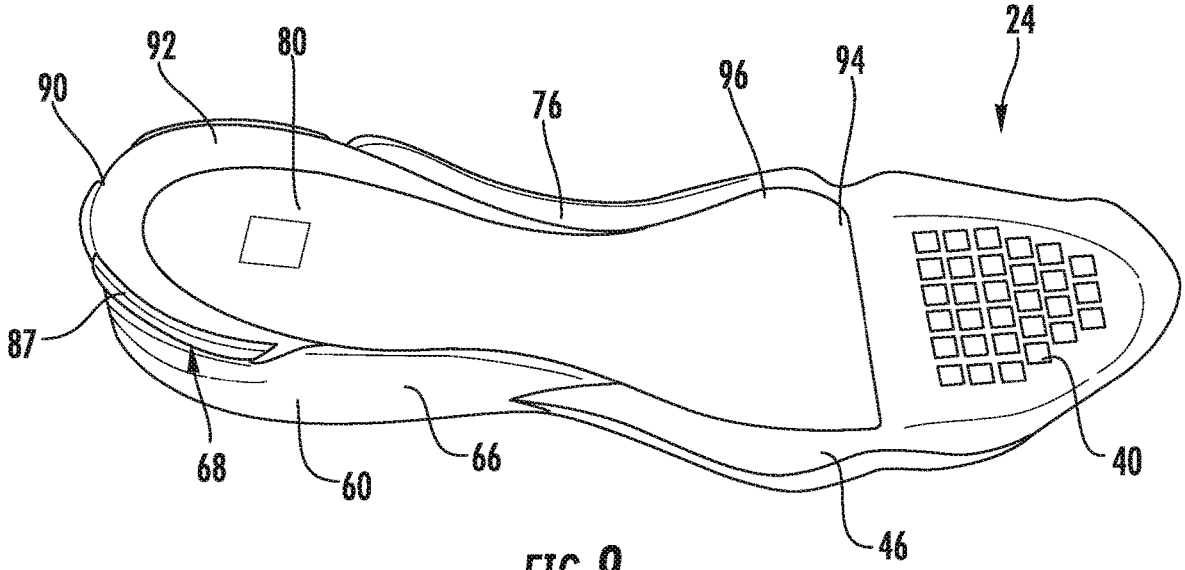
FIG. 9 shows a perspective view of the sole of FIG. 1 in isolation from the upper with the midsole member positioned on an outsole.
Figure 11:
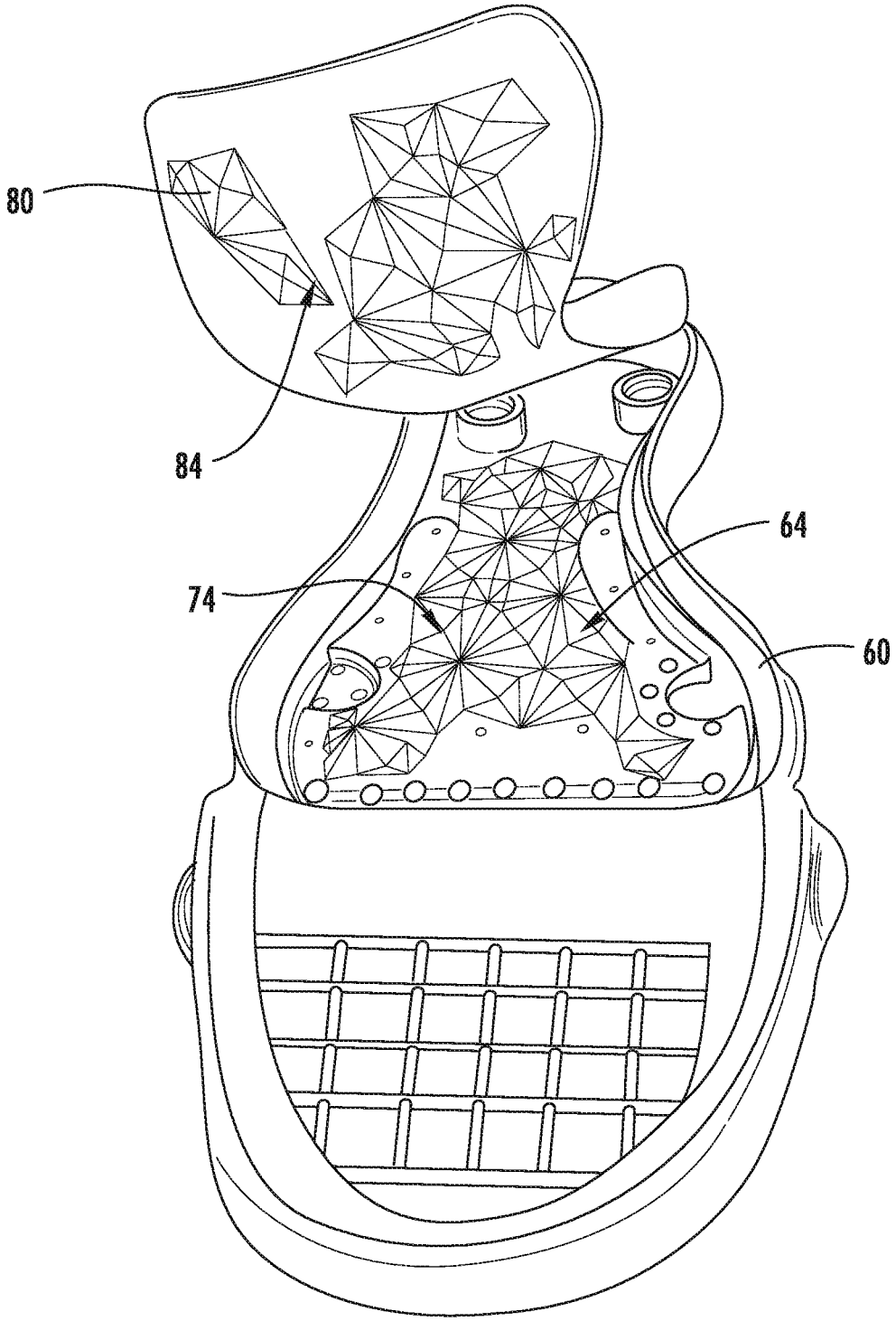
FIG. 11 shows the midsole member of FIG. 10 being inserted onto the outsole with the textured lower surface of the midsole facing the textured inner surface of the outsole.
Figure 12:
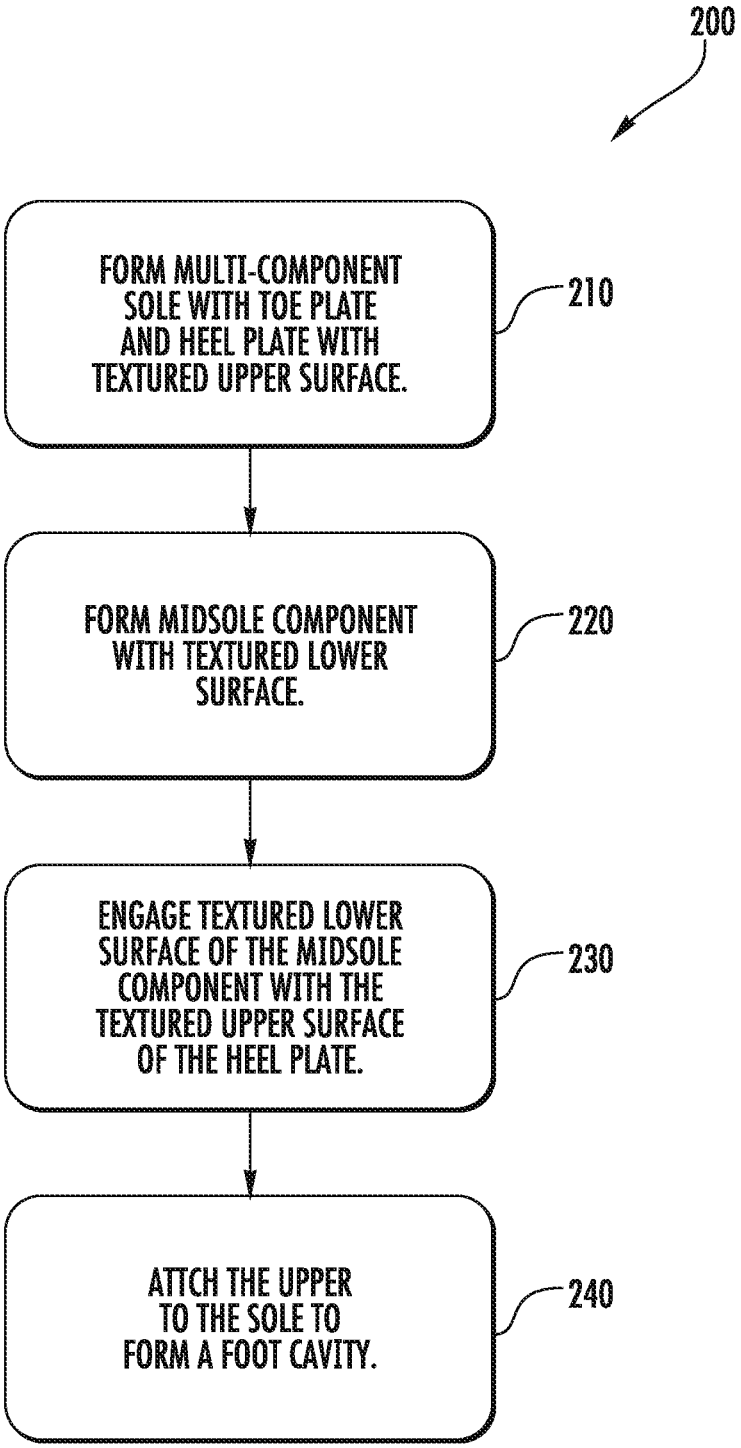
FIG. 12 shows a block diagram of a method of making an article of footwear with an interlocking midsole member.

With reference now to FIGS. 9-11, it can be seen that the midsole member 80 is releasable from the heel plate 60. FIG. 9 shows the midsole member 80 positioned in the slot of the heel plate 60 with the catch 76 engaging the midsole member. In this position, the sidewalls 66 of the heel plate 60 closely engage the sidewalls 86 of the midsole member 80, further assisting in retaining the midsole member 80 in the heel plate. Additionally, the textured inner surface 64 of the heel plate 60 directly engages the textured lower surface 84 of the midsole member 80 in a complementary manner, further preventing movement of the midsole member 80 relative to the heel plate. Direct engagement of the textured inner surface 64 of the heel plate 60 with the textured lower surface 84 of the midsole member 80 means that no adhesives are necessary between the textured inner surface 64 and the textured lower surface 84 in order to secure the midsole member 80 in plate relative to the heel plate 60. Indeed, in at least one embodiment, the midsole member 80 is retained in the slot 74 of the heel plate without the need for any adhesives, welding, stitching, or any other attachment means.

As shown in FIGS. 10-11, because no adhesives or other attachment means are used to secure the midsole member 80 to the heel plate 60, the midsole member 80 is removable from the heel plate 60. Accordingly, in at least one embodiment, even after the midsole member 80 is coupled to the heel plate 60 as shown in FIG. 9, the midsole member 80 may be completely removed from the heel plate 60 as shown in FIG. 10, thus exposing the textured inner surface 64 of the heel plate 60. Thereafter, the midsole member 80 may be repeatedly coupled to and removed from the heel plate. FIG. 11 shows the midsole member 80 in the process of being either removed from or positioned in the heel plate 60. As discussed previously, the bottom textured surface 84 on the midsole member 80 and the upper textured surface 64 on the heel plate 60 are complementary and face each other when the midsole member is positioned in the sole 24. Together, the sole 24 and the upper 22 form a foot cavity, but no adhesives or other permanent fastening means are used to secure the midsole member 80 to the heel plate 60 or other portion of the sole 24. Instead, the midsole member 80 may be free floating in the foot cavity. Even when the midsole member 80 is free floating in the foot cavity, the slot 74, catch 76, and textured inner surface 64 of the heel plate act to retain the midsole member 80 in place within the foot cavity.

As also shown in FIG. 10, in at least one embodiment the inner textured surface of the heel plate 60 includes at least one spike 78. The at least one spike 78 is configured to embed into the relatively soft material of the midsole member 80 when the midsole member 80 is engaged with the heel plate 60 and a force is applied to the midsole member 80 in the direction of the heel plate. The at least one spike 78 extends a sufficient height above the textured inner surface 64 to embed into the midsole member 80, but is generally short enough to prevent a wearer of the shoe from perceiving the existence of the spike 78 below his or her foot. Moreover, because the midsole member is comprised of a resilient material, the spike 78 may deform when pressure is applied to spike through the midsole member 80.

While the midsole member 80 has been described herein as directly engaging the heel plate 60, or even free floating within the foot cavity, it will be recognized that in alternative embodiments the midsole member 80 may be adhered to or otherwise secured to the heel plate 60, thus fixing the midsole member 80 in place within the foot cavity. In at least one embodiment as shown in FIGS. 9 and 10, the midsole member further includes lateral heel tabs 87 on the medial and lateral sides at the top of the sidewalls 86. The heel tabs 87 are used to further assist with fixing the midsole member 80 in place within the foot cavity. The heel tabs 87 are configured to rest within the recesses 68 in the sidewalls 66 of the heel plate 60. When the upper 22 is attached to the sole 24, the heel tabs 87 are trapped between the sidewalls 66 of the heel plate 60 and the upper 22. As shown in FIG. 1, placement of the tabs 87 in the recesses 68 results in exposure of the tabs 87 on the exterior of the shoe 20 between the upper 22 and the sole 24. In at least one embodiment, adhesives, welding or other fastening means are used to secure the heel tabs within the recesses 68 and/or to the upper 22.

With reference now to FIG. 11, a method 200 is disclosed for making an article of footwear. The method 200 begins as shown in block 210 by forming a multi-component sole including a toe plate and a heel plate. As described previously, the heel plate has a greater hardness than the toe plate. The heel plate includes an upper textured surface including a pattern of repeating shapes. The heel plate further includes at least one catch removed from the upper textured surface.

As shown in block 220, the method 200 also includes forming a midsole member including a lower textured surface and at least one retaining wall. The lowered textured surface is complementary to the upper textured surface of the sole. The midsole member may be formed before, after, or contemporaneous with the multi-component sole.

As shown in block 230, after the multi-component sole and the midsole member are formed, the textured lower surface of the midsole member is engaged with the complementary textured upper surface of the heel plate. In at least one embodiment, the textured lower surface of the midsole member is directly engaged with the complementary textured upper surface of the heel plate and no adhesives are provided between these surfaces. When the midsole member is moved into contact with the heel plate, a catch on the heel plate abuts a surface on the midsole member and couples the midsole member to the heel plate.

As shown in block 240, after the midsole member is coupled to the multi-component an upper is connected to the multi-component sole such that a foot cavity is defined by the multi-component sole and the upper. In at least one embodiment, no adhesives, stitching, welding or fastening means of any kind is provided between the midsole member and the heel plate and/or the upper, and the midsole member is free floating in the foot cavity relative to the heel plate and the upper.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

What is claimed is:

1. An article of footwear comprising:

an upper;

a first sole member connected to the upper, the first sole member and upper defining a cavity, the first sole member including an outer surface and a textured inner surface, the textured inner surface defining a pattern of shapes, the first sole member including a toe plate and a heel plate with the textured inner surface provided on the heel plate, the toe plate having an inner surface that does not include the pattern of shapes; and a second sole member positioned in the cavity, the second sole member including a textured lower surface directly engaging the textured inner surface of the first sole member, the textured lower surface of the second sole member complementary to the textured inner surface of the first sole member;

wherein the heel plate has a greater hardness than the toe plate, and the toe plate has a greater hardness than the second sole member; and wherein the textured inner surface of the first sole member includes a pattern of faceted polygon structure; wherein each faceted polygon is a rhombus with a plurality of triangular facets having a common central vertex; and wherein the plurality of faceted rhombus are contiguous, such that a first side of a triangular facet on a first rhombus abuts a second side of a triangular facet on a second rhombus.

2. The article of footwear of claim 1 wherein the textured inner surface of the first sole member interlocks with the textured lower surface of the second sole member such that the second sole member is blocked from sliding relative to the first sole member.

3. The article of footwear of claim 1 wherein each faceted polygon includes a plurality of adjacent facets and a groove or a peak is defined between each adjacent facet.

4. The article of footwear of claim 1 wherein the outer surface of the first sole member includes a plurality of traction members.

5. The article of footwear of claim 1 wherein the first sole member is comprised of a substantially transparent material such that the textured inner surface of the first sole member is visible through the outer surface.

6. The article of footwear of claim 1 wherein the second sole member is free-floating relative to the first sole member within the cavity.

7. The article of footwear of claim 1 wherein the second sole member is adhered to the first sole member within the cavity.

8. The article of footwear of claim 1, the first sole member includes a plurality of spike members positioned on the textured inner surface and embedded in the second sole member.

9. The article of footwear of claim 1 wherein the first sole member includes a sidewall with an upper recess, and wherein the second sole member includes a heel tab positioned in the recess and exposed on an exterior of the article of footwear.

10. The article of footwear of claim 1 wherein the first sole member includes a catch configured to retain the second sole member with the textured inner surface of the first sole member in direct engagement with the textured lower surface of the second sole member.

11. The article of footwear of claim 10 wherein the catch is a rib on an interior of a sidewall of the first sole member, the rib abutting an angled portion of a sidewall on the second sole member.

12. The article of footwear of claim 1 wherein the toe plate further includes a forward portion, a medial arm, and a lateral arm, the medial arm extending along a perimeter of the sole in a medial plantar facia region, the lateral arm extending along the perimeter of the sole in a lateral plantar fascia region, and the heel plate extending to a region between the medial arm and the lateral arm.

13. An article of footwear comprising:

a multi-component sole including a heel plate and a toe plate, the heel plate having a greater hardness than the toe plate, the heel plate including a textured upper surface defining a first pattern of shapes; and a midsole member engaging the heel plate of the multi-component sole, the midsole member including textured lower surface defining a second pattern of shapes that is complementary to the first pattern of shapes, the textured lower surface of the midsole member interlocked with the textured upper surface of the heel plate such that the midsole is blocked from sliding relative to the heel plate, the midsole member having a lesser hardness than the heel plate; and wherein the textured inner surface of the first sole member includes a pattern of faceted polygon structures; and wherein the plurality of faceted polygons are contiguous and such that a first side of a triangular facet on a first rhombus abuts a second side of a triangular facet on a second rhombus.

14. The article of footwear of claim 13 wherein the midsole member is positioned in a slot of the heel plate and is tapered between a heel end and a toe end.

15. The article of footwear of claim 13 wherein the heel plate has a greater hardness than the toe plate, the toe plate further including a forward portion, a medial arm, and a lateral arm, the medial arm extending along a perimeter of the sole in a medial plantar facia region, the lateral arm extending along the perimeter of the sole in a lateral plantar fascia region, and the heel plate extending to a region between the medial arm and the lateral arm on the sole.

* * * * *